US011365622B2

(12) United States Patent
Patterson

(10) Patent No.: US 11,365,622 B2
(45) Date of Patent: Jun. 21, 2022

(54) TILTING ENTRY GUIDE

(71) Applicant: Halliburton Energy Services, Inc., Houston, TX (US)

(72) Inventor: Daniel Luther Patterson, East Tawakoni, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 335 days.

(21) Appl. No.: 16/604,994

(22) PCT Filed: Dec. 28, 2018

(86) PCT No.: PCT/US2018/067971
§ 371 (c)(1),
(2) Date: Oct. 11, 2019

(87) PCT Pub. No.: WO2020/139384
PCT Pub. Date: Jul. 2, 2020

(65) Prior Publication Data

US 2021/0355811 A1 Nov. 18, 2021

(51) Int. Cl.
*E21B 47/01* (2012.01)
*E21B 17/04* (2006.01)
*E21B 47/024* (2006.01)

(52) U.S. Cl.
CPC ..... *E21B 47/01* (2013.01); *E21B 17/04* (2013.01); *E21B 47/024* (2013.01)

(58) Field of Classification Search
CPC ..... E21B 47/01; E21B 47/024; E21B 17/04; E21B 23/03
See application file for complete search history.

(56) References Cited

U.S. PATENT DOCUMENTS 4,321,965 A * 3/1982 Restarick ..... E21B 31/14 166/117.5
4,697,651 A 10/1987 Dellinger
5,111,891 A * 5/1992 Kinnan ..... E21B 7/18 175/21
5,415,238 A 5/1995 Nice
7,677,335 B2 3/2010 Cao et al.
9,512,713 B2 12/2016 Ahmed et al.
2006/0207769 A1* 9/2006 Corbett ..... E21B 33/10 166/380
2008/0156479 A1* 7/2008 Cassidy ..... E21B 23/12 166/117.5
2013/0299188 A1* 11/2013 Ahmed ..... E21B 17/1014 166/381

OTHER PUBLICATIONS

PCT Application Serial No. PCT/US2018/067971, International Search Report, dated Sep. 24, 2019, 3 pages.
PCT Application Serial No. PCT/US2018/067971, International Written Opinion, dated Sep. 24, 2019, 6 pages.

* cited by examiner

*Primary Examiner* — David Carroll
(74) *Attorney, Agent, or Firm* — DeLizio, Peacock, Lewin & Guerra

(57) ABSTRACT

An apparatus for miming production tubing string into a wellbore without rotating the production tubing string is disclosed. The apparatus is a muleshoe guide assembly utilizing a short coil spring to tilt a lower muleshoe guide into alignment with a packer bore or liner top. When the guide encounters an obstruction in the wellbore, the short coil spring will compress causing a lug to be driven into an angled milled slot causing the lower muleshoe guide to tilt inward.

20 Claims, 9 Drawing Sheets

TILTING ENTRY GUIDE

TECHNICAL FIELD

The disclosure generally relates to the field of earth or rock drilling (mining), and more particularly to well equipment or well maintenance.

BACKGROUND ART

Traditional well construction, such as drilling of an oil or gas well, consists of three phases: drilling, lining with casing, and production with tubing. In the drilling phase, rock is cut away until a deposit is reached. This establishes a wellbore or borehole through a series of formations. Each formation through which the well passes must be sealed so as to avoid an undesirable passage of formation fluids, gases, or materials out of the formation and into the borehole or from the borehole into the formation. In addition, it is often desired to isolate both producing and non-producing formations from each other to avoid contaminating one formation with fluids from another formation.

Lining the wellbore with casing protects the formation layers and stabilizes the wellbore. Packers and liners are often used in lining the wellbore to separate fluid types. Packers are tools used to form an annular seal between two concentric strings of pipe or between the pipe and the wall of the open hole and are usually set just above the producing zone to isolate the producing interval from the casing annulus or from producing zones elsewhere in the wellbore. At times, it is not desired for the casing to extend all the way to the surface of the wellbore, in which case a liner is used. A liner is a casing string that does not extend to the top of the wellbore, but instead is anchored or suspended from inside the bottom of the previous casing string.

Production tubing is run into a drilled well after the casing is run and set in place. Production tubing protects the wellbore casing from wear, tear, and corrosion while providing a continuous bore from the producing zone to the wellhead. When sections of production tubing are run into a wellbore, they often run through a packer or liner top to interconnect them. However, packer bores and liner tops are substantially centered in the wellbore. If the wellbore is deviated, the production tubing will tend to engage the edge of the packer bore or liner top instead of entering it. In order to correct this issue, the production tubing is maneuvered to enter the packer bore or liner top. A guide is attached to the lower end of the production tubing to facilitate entering a packer bore or maneuvering past downhole obstructions. The guide typically includes a muleshoe geometry such that rotation of the muleshoe will allow the end of the guide to bypass the top of a packer or obstruction. This rotation may be accomplished by rotating the entire production tubing from the surface. However, when running the production tubing string into a wellbore, the ability to rotate the production tubing string to enter into packer bores or liner tops may be prevented due to control lines attached to the tubing and/or extreme hole angles. When rotation of the production tubing is not feasible, there are self-aligning muleshoe guides available that will rotate as the weight of the production tubing string applied to the guide increases due to the guide setting down on a packer bore or liner top. A guide with a muleshoe geometry will enter the packer bore or liner top after sufficient rotation. After the guide enters the packer or liner top, the bottom end of the guide will typically rotate back to the original position with the assistance of a spring. In addition, the spring designed for use in the guide is designed for the harsh downhole environment, which incurs a significant cost in material and design.

BRIEF DESCRIPTION OF THE DRAWINGS

Embodiments of the disclosure may be better understood by referencing the accompanying drawings.

DESCRIPTION OF EMBODIMENTS

Figure 1:
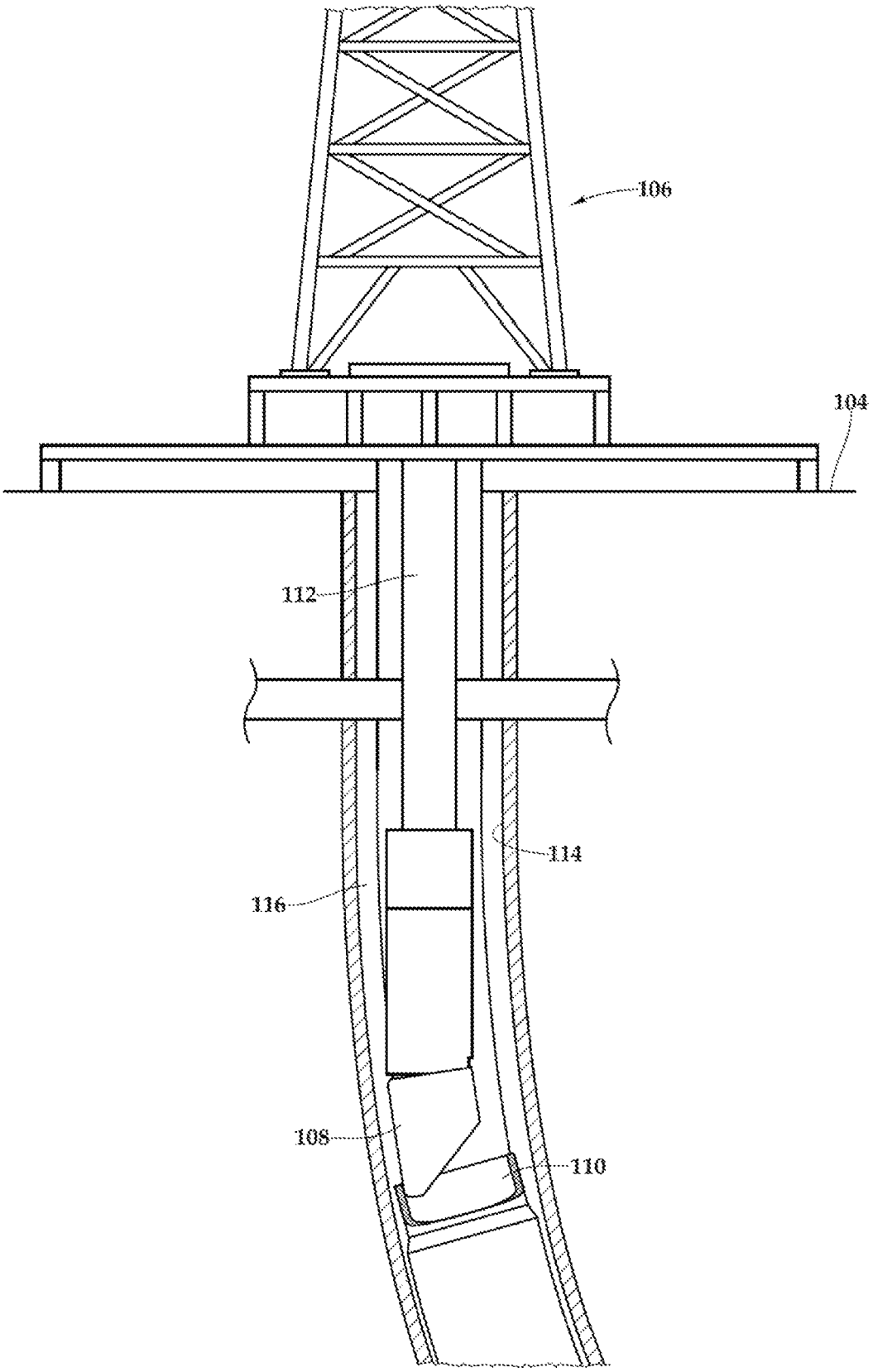
FIG. 1 depicts a schematic diagram of a well system making use of a tilt guide assembly with a muleshoe geometry.

The description that follows includes example systems that embody embodiments of the disclosure. However, it is understood that this disclosure may be practiced without these specific details. For instance, this disclosure refers to a guide assembly for entering a packer bore or liner top in a wellbore for subsurface drilling operations in illustrative examples. Embodiments of this disclosure can also be applied to subsea drilling operations. In other instances, well-known instruction instances, protocols, structures and techniques have not been shown in detail in order not to obfuscate the description.

Overview

When running production tubing string into a wellbore, a guide is often used on the bottom end of the string to assist maneuvering downhole. Guides are used to keep production tubing centered within the wellbore, thus minimizing problems associated with tubing hitting obstructions (e.g., rock ledges or objects) in the wellbore as the tubing is lowered into the well. A guide has been designed that includes a spring to tilt a guide shoe to guide equipment past obstructions. This tilting (or canting) guide has been designed with a short coil spring and a lug on an upper mandrel in a milled slot on a guide shoe to place a guide shoe in an orientation to enter a packer bore or liner top, for example. The short coil spring is placed between an upper mandrel and an inner mandrel (hereinafter "inner spring mandrel"). The upper mandrel surrounds the outer diameter of the short coil spring. The inner spring mandrel is inside the inner diameter of the short coil spring. The two mandrels protect the short coil spring from outside wear and tear. When the guide shoe encounters an obstruction, forces are applied to both ends of the short coil spring by the upper mandrel and a lower inner mandrel. The lower inner mandrel applies an upward force on the spring due to contact with the obstruction while the upper mandrel applies a force equal to the weight of at least the guide itself. These forces compress the short coil spring.

The guide assembly has a slot or gap between the lower muleshoe guide and the upper mandrel. As the short coil spring is compressed, the gap between the lower muleshoe guide and the upper mandrel closes causing the lug on the upper mandrel to be pushed into the milled slot on the lower muleshoe guide. The milled slot is angled to act as a ramp for the lug to move along. Compression of the short coil spring drives the lug into the milled slot which causes the lower muleshoe guide to tilt. A slot in the upper mandrel allows the lower inner mandrel to move unrestricted as the lower muleshoe guide tilts inward. The lower muleshoe guide tilts until it can pass the obstruction. Once the lower muleshoe guide has passed the obstruction, the forces are removed from the short coil spring allowing it to decompress, and the lower muleshoe guide returns to its original alignment.

This guide assembly features a lower muleshoe guide at the end that tilts instead of rotating. The guide assembly uses a short coil spring to allow the guide shoe longitudinal movement sufficient to tilt to pass an obstruction and to return to longitudinal alignment with the guide when the obstruction has been passed. This allows for the guide to be shorter overall than traditional production tubing string guides, making this a more economical design. In addition, the short coil spring requires a shorter compression distance than a traditional long coil spring and should be more reliable and less prone to fouling from debris than a long coil spring.

Example Illustrations

In the following description of a tilting guide assembly and other apparatus and methods described herein, directional terms, such as "inner", "outer", "upper", "lower", etc., are used only for convenience in referring to the accompanying drawings. Specifically, upper and lower are used to refer to different regions, parts, portions, or components of an assembly or equipment when vertically oriented. Additionally, it is to be understood that the various embodiments of the inventive subject matter described herein may be utilized in various orientations, such as inclined, inverted, horizontal, vertical, etc., and in various configurations, without departing from the principles of the embodiments.

FIG. 1 depicts a schematic diagram of a well system making use of a tilting guide assembly to run a production tubing string into the wellbore. FIG. 1 depicts an example of a well system after a vertical wellbore 114 has been drilled. The well system includes a platform 106 positioned on the earth's surface 104 and extending over and around the wellbore 114. The wellbore 114 extends vertically from the earth's surface 104.

In particular, FIG. 1 depicts the wellbore 114 in which a packer 110 has been inserted downhole. The packer 110 closes off a space between the open hole and a wellbore casing 116 before a production tubing string 112 is run. The packer 110 contains a bore through which the production tubing string can be run. The production tubing string 112 is run into the wellbore 114 with the aid of a guide 108. The guide 108 is a tilting muleshoe guide attached to the lower end of the production tubing string 112. The guide 108 is designed to utilize a spring to align, if needed, to enter the packer 110 without rotating the production tubing string 112.

Figure 2:
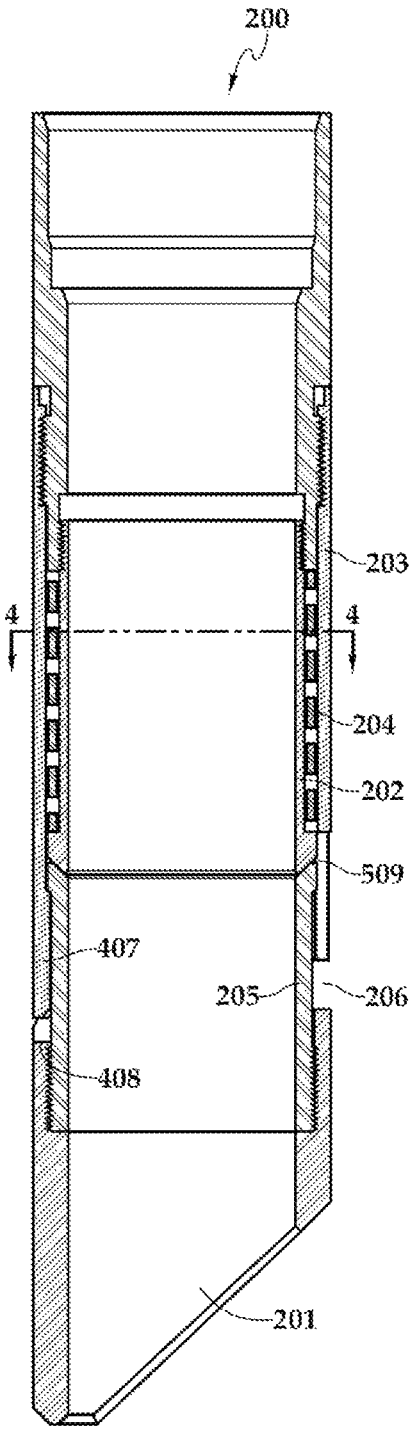
FIG. 2 depicts an embodiment of a tilt guide assembly with a short coil spring.

FIG. 2 depicts an embodiment of a tilt guide assembly with a short coil spring for alignment with a packer bore or liner top. This embodiment does not need to rotate the guide to enter the packer bore or liner top. Instead, a short coil spring between two mandrels holds the lower end of the guide assembly straight under non-loaded conditions. When a force is applied to a lower muleshoe guide, the spring is compressed allowing the lower muleshoe guide to bend to enter the packer bore or liner top. The guide assembly 200 consists of an upper mandrel 203 and a lower muleshoe guide 201. The upper mandrel 203 and the lower muleshoe guide 201 are related by a tab or lug 407 on the upper mandrel 203 and a slot 408 in the lower muleshoe guide 201. The guide assembly 200 further consists of an inner spring mandrel 202 and a lower inner mandrel 205. A slot or gap 206, between the lower muleshoe guide 201 and the upper mandrel 203, and a cutout or slot 509 in the lower inner mandrel 205 allow the lower muleshoe guide 201 to tilt to maneuver the guide assembly past obstructions. A spring 204 wraps around the inner spring mandrel 202.

Under non-loaded conditions, when no force is applied to the lower muleshoe guide 201, the spring 204 holds the lower muleshoe guide 201 in alignment with the central axis of the guide assembly 200. When the guide encounters an obstruction, such as a packer or liner top in a wellbore, the weight of the upper mandrel 203 and the connected production tubing will apply a downward force on the spring 204. The lower muleshoe guide 201, prevented from downward movement in the wellbore through contact with an obstruction, causes the lower inner mandrel 205 to apply an upward force on the spring 204. Together, the downward force from the upper mandrel 203 and the upward force from the lower inner mandrel 205 compress the spring 204. The gap 206 between the lower muleshoe guide 201 and the upper mandrel 203 allows the lower muleshoe guide 201 to move and tilt as the spring 204 is compressed.

Figure 3:
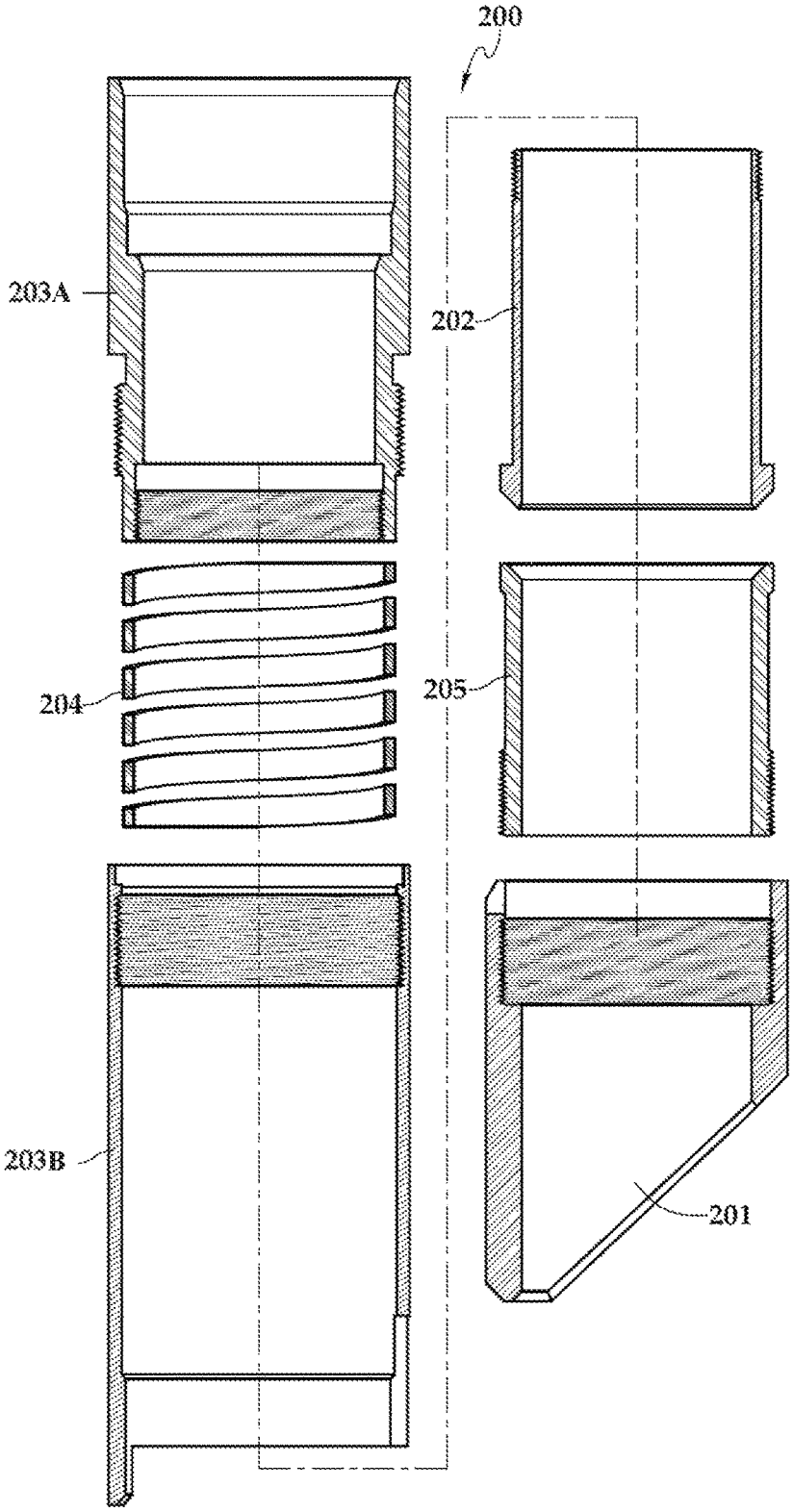
FIG. 3 is an exploded view of a tilt guide assembly with a short coil spring.

FIG. 3 is an exploded view of a tilt guide assembly with a short coil spring. The broken projection line shows the orientation of the pieces of the tilt guide assembly 200 of FIG. 2 from top to bottom. The upper mandrel is depicted as two pieces, 203A and 203B, to show the location of the spring 204 inside the upper mandrel 203. The inner spring mandrel 202 is positioned inside the spring 204 with a lower portion of the inner spring mandrel extending beyond the bottom of the spring 204. The lower inner mandrel 205 is below the inner spring mandrel 202, inside the upper mandrel 203. The bottom portion of the lower inner mandrel 205 extends beyond the bottom of the upper mandrel 203 and connects to the lower muleshoe guide 201.

Figure 4:
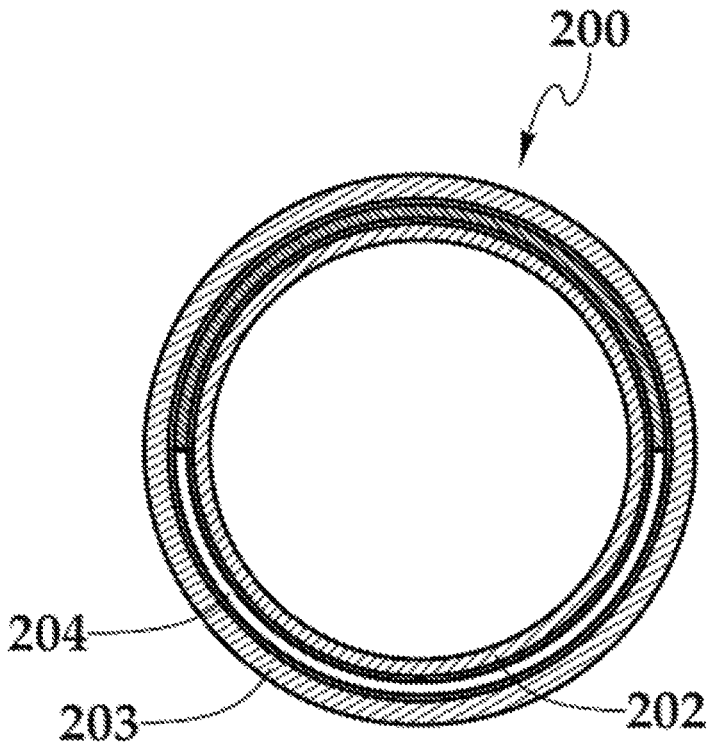
FIG. 4 is an axial top view of a tilt guide assembly with a short coil spring.

FIG. 4 is an axial top view of the tilt guide assembly 200 of FIG. 2. This view shows the orientation of the spring in relation to the upper mandrel and the inner spring mandrel. FIG. 4 depicts the inner spring mandrel 202 and the upper mandrel 203 of FIG. 2. The spring 204 is a short coil spring positioned in between the inner spring mandrel 202 and the upper mandrel 203. The spring 204 expands and contracts longitudinally between the mandrels when forces are applied to either end of the spring 204. The length of the short coil spring is designed to allow the muleshoe.

Figure 5:
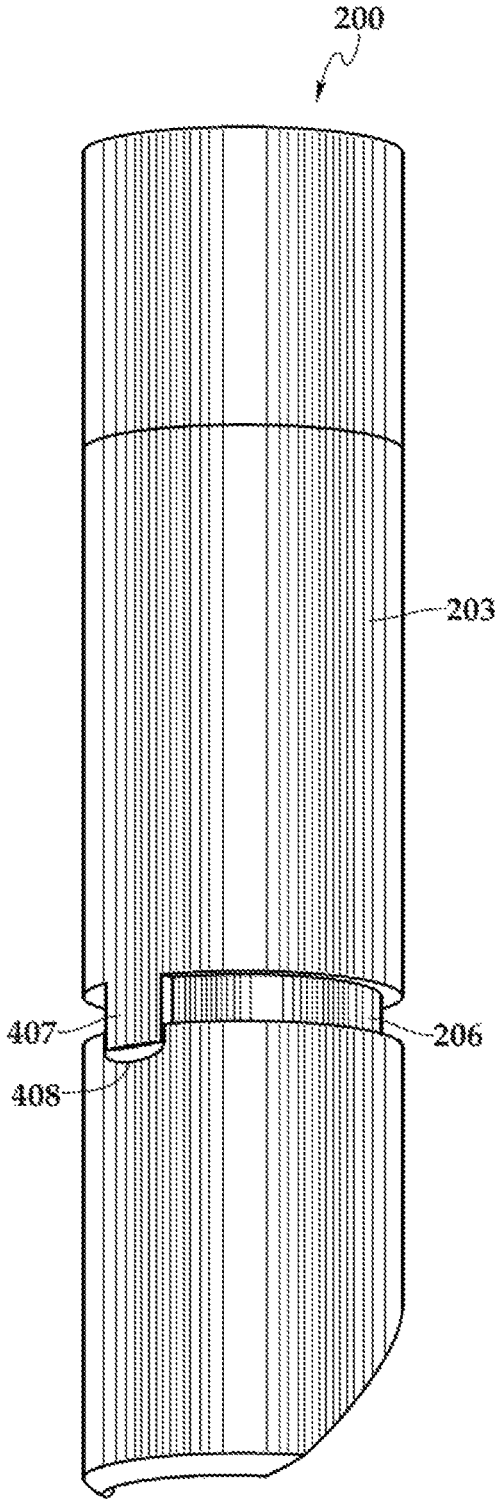
FIG. 5 is a longitudinal view of a tilt guide assembly with a short coil spring as viewed from below.

FIG. 5 is a longitudinal view of the tilt guide assembly 200 of FIG. 2 as viewed from a perspective showing a lug and a ramped, milled slot. This view of the tilt guide assembly 200 illustrates a lug 407 on the upper mandrel 203. The lug 407 is a part or member extending longitudinally downward from the bottom of the upper mandrel 203. Embodiments may design the lug 407 (or tab) to be an extending part of the upper mandrel or an extending component attached or affixed to the upper mandrel. The lug 407 rides in a milled slot 408 on the lower muleshoe guide 201. The milled slot 408 acts as an angular ramp for the lug 407. As the spring inside the upper mandrel 203 compresses, the muleshoe guide 201 moves closer to the upper mandrel 203, reducing the space between the two in gap 206. This causes lug 407 to enter further into the milled slot 408. The angled ramp of the milled slot 408 forces the muleshoe guide 201 to move inward at an angle until the lower muleshoe guide 201 enters the packer bore or liner top. The spring 204 has a length designed to allow the muleshoe guide 201 or shoe to move a distance sufficient to allow the lug 407 to tilt or kick out the muleshoe guide 201 from being longitudinally aligned. The length of the lug 407 can be approximately 3-4 centimeters but may be designed to be a length sufficient to tilt the muleshoe guide 201 out a desired angle from a central axis of the guide assembly. This length can vary dependent upon the size of the assembly (e.g., diameter of the upper mandrel, size of the shoe, etc.). After entrance, the lower muleshoe guide 201 will straighten to its original position since the force compressing the spring is removed.

Figure 6:
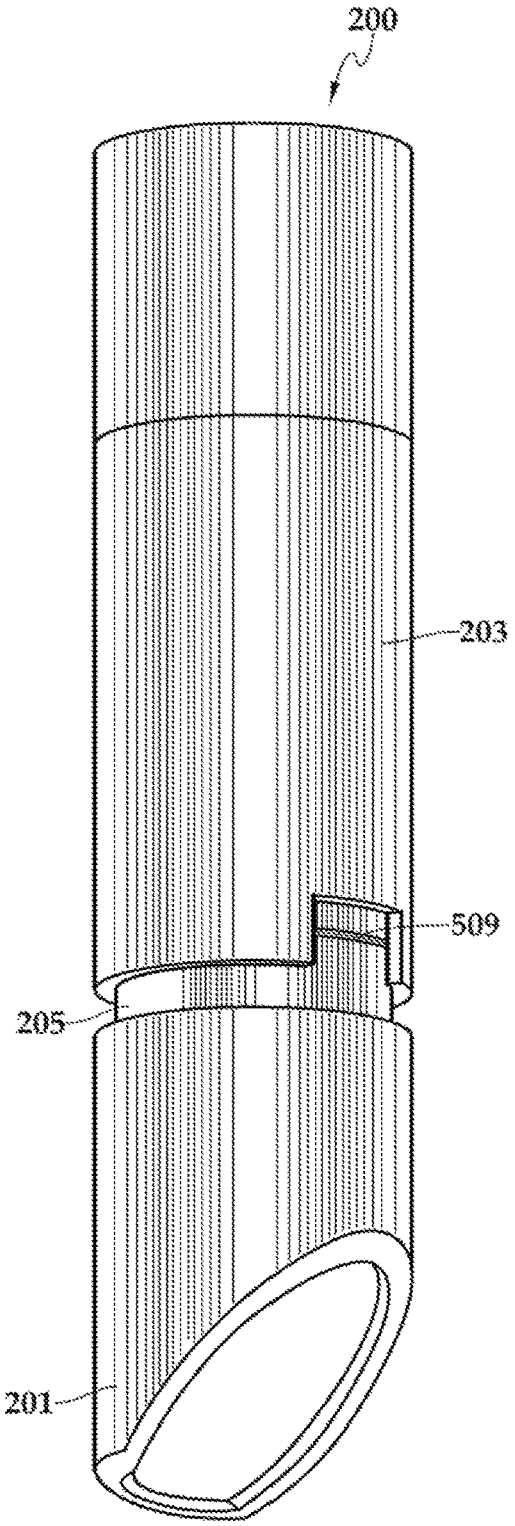
FIG. 6 is a longitudinal view of a tilt guide assembly with a short coil spring as viewed from above.

FIG. 6 is a longitudinal view of the tilt guide assembly 200 of FIG. 2 as viewed from a perspective opposite the perspective in FIG. 5. An inner mandrel slot 509 allows the inner mandrel 205 to move unrestricted. As the muleshoe guide 201 aligns to enter a packer bore or liner top, the inner mandrel slot 509 allows the inner mandrel 205 to move along with the muleshoe guide 201 while still applying an upward force to compress the spring inside the upper mandrel 203.

Figure 7:
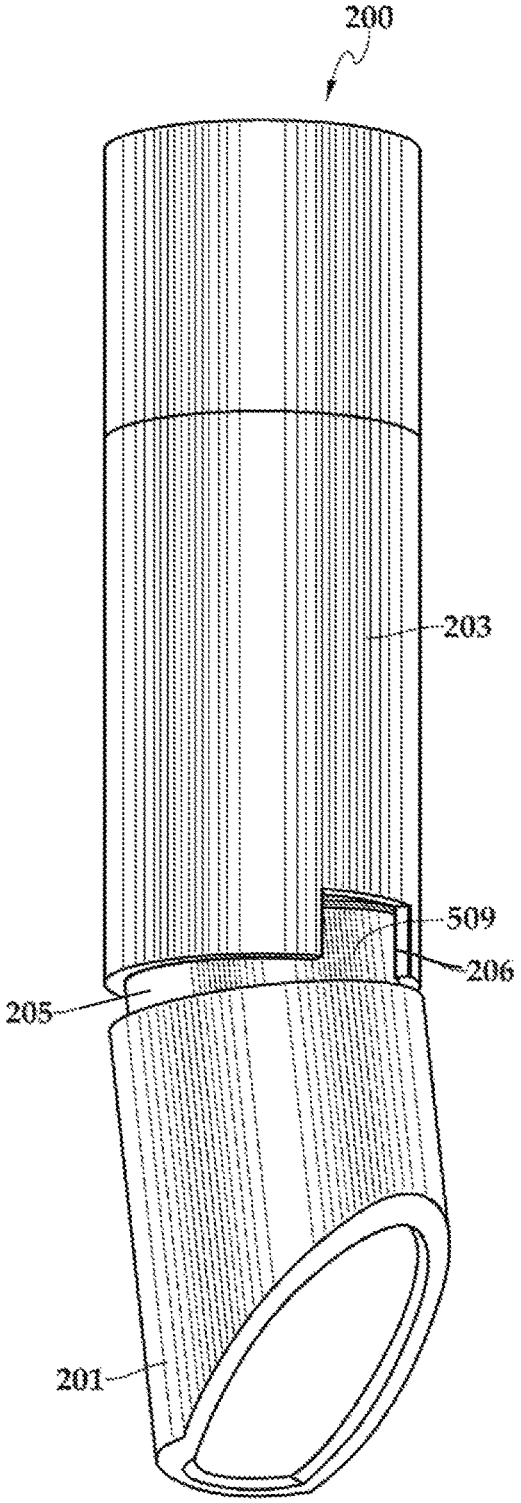
FIG. 7 illustrates the alignment of a tilt guide assembly with a short coil spring after actuating to enter a packer or liner top.

FIG. 7 illustrates the alignment of the tilt guide assembly 200 of FIG. 2 after actuating to enter a packer or liner top. FIG. 7 depicts an example alignment that may allow the lower muleshoe guide 201 to enter a packer bore or liner top. In actuating to enter the packer bore or liner top, muleshoe guide 201 tilts to be positioned at a slight angle relative to upper mandrel 203. This angular movement is allowed due to inner mandrel slot 509 and gap 206.

Another embodiment of a tilt guide assembly that does not use a long spring to enter packer bores or liner tops is depicted in FIGS. 8A-B and 9A-B. While these figures depict an example of an embodiment of a tilt guide assembly with a leaf spring with multiple arced sheets, other embodiments of a spring may be used. For instance, a leaf spring comprised of a single layer may be used in place of the multiple arced layer leaf spring. The spring design may be a leaf spring but is not limited to a leaf spring design. Other types of springs may be used such as a wire spring or torsion spring. The spring does not have to be arced. It may also be flat or coiled.

Figure 8A:
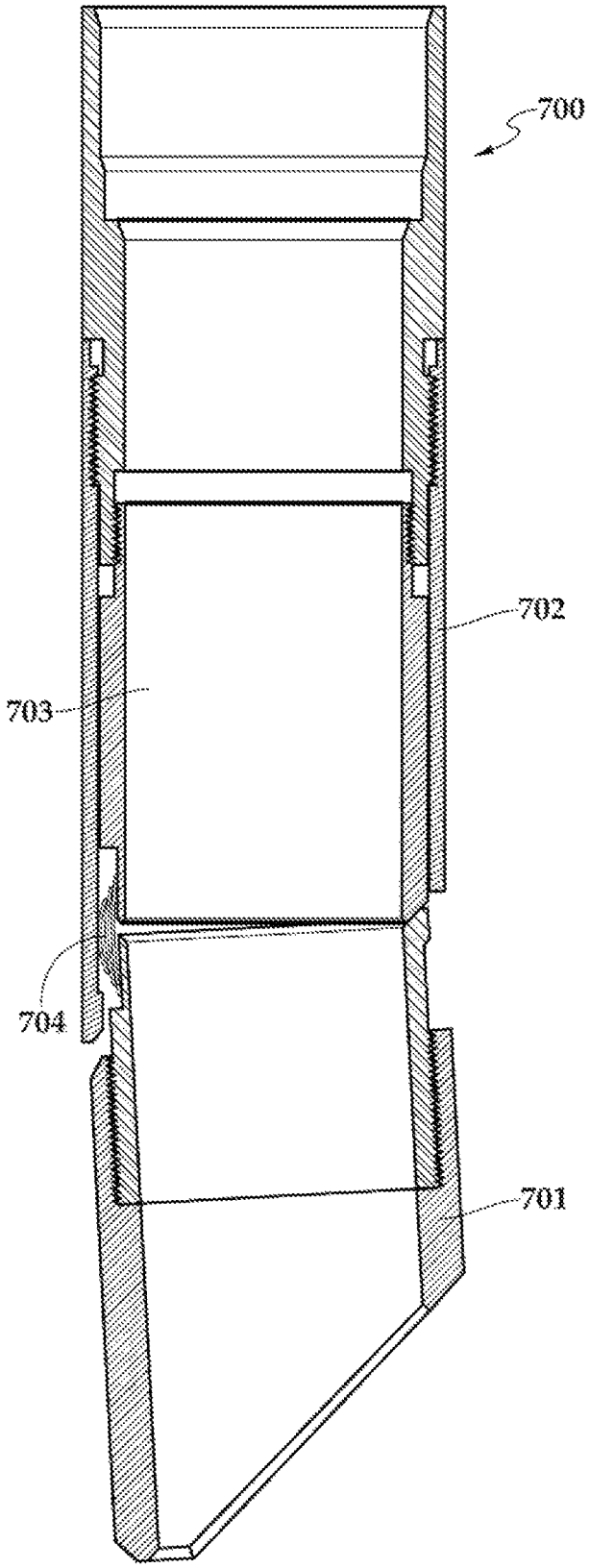
FIGS. 8A and 8B depict a tilt guide assembly with a leaf spring.

FIG. 8A depicts an embodiment of a tilt guide assembly with a leaf spring. Like the previously described embodiment, the tilt guide assembly 700 consists of a lower muleshoe guide 701 and an upper mandrel 702. The lower muleshoe guide 701 and the upper mandrel 702 have a portion with a spacing or slot between them that allows the lower muleshoe guide 201 to tilt or kick inward. Additionally, the tilt guide assembly 700 consists of an inner mandrel 703 and a leaf spring 704. In this embodiment, the lower muleshoe guide 701 is positioned off-center from the central longitudinal axis of the guide assembly 700 while running production tubing string into a wellbore. The leaf spring 704 is positioned between the upper mandrel 702 and the inner mandrel 703. While running production tubing string in a wellbore, the arc structure of leaf spring 704 pushes the lower muleshoe guide 701 away from the casing wall of the wellbore.

Figure 8B:
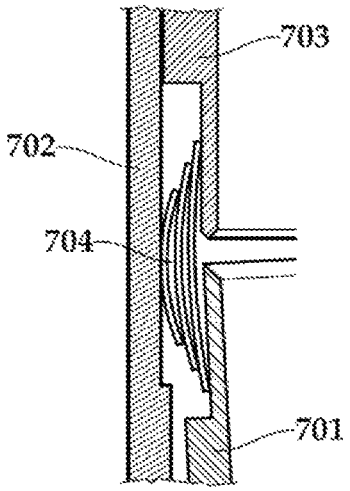

FIG. 8B depicts the structure of the leaf spring when no forces are applied to the tilt guide assembly 700 of FIG. 8A. The leaf spring 704 comprises layers of arced sheets. The sheets vary in size and curvature from top to bottom. The sheet closest to the inner mandrel 703 and lower muleshoe guide 701 is the longest and straightest of the sheets while the sheet closest to the upper mandrel 702 is the shortest and most curved sheet.

Figure 9A:
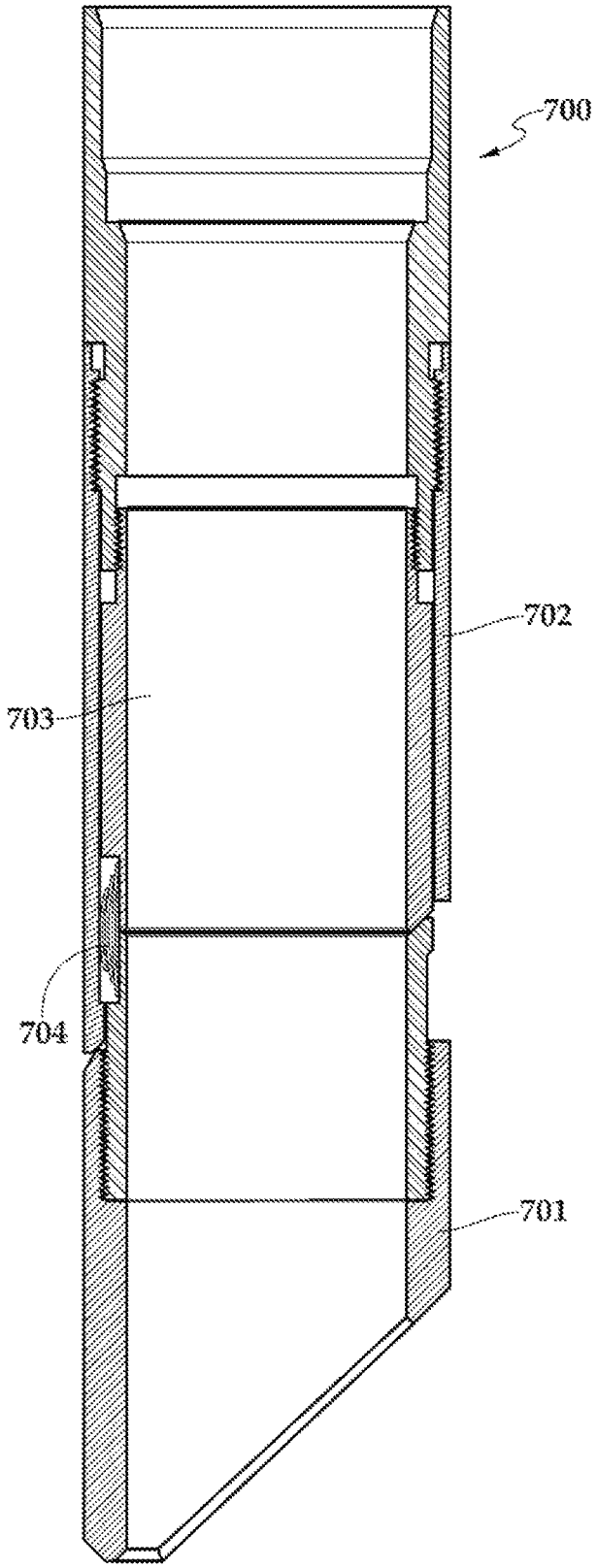
FIGS. 9A and 9B illustrate the position of a tilt guide assembly with a leaf spring after aligning to enter a packer bore.

If a packer bore or liner top is encountered, the end of the guide will easily enter the packer bore because of the off-center bias of the muleshoe guide. FIG. 9A illustrates the position of the tilt guide assembly 700 of FIG. 8A after entering a packer bore. In FIG. 9A, the lower muleshoe guide 701 has straightened to be aligned with the longitudinal axis of the tilt guide assembly 700. When the tilt guide assembly 700 encounters a packer bore or liner top, the lower muleshoe guide 701 will enter the packer bore. The smaller inner diameter of the packer bore will apply a force on the lower muleshoe guide 701. As the lower muleshoe guide 701 straightens to align with the packer bore, a force is applied to the leaf spring 704. While the guide assembly 700 is within the packer bore, the force on the leaf spring 704 will straighten the arc structure of the spring and hold the lower muleshoe guide 701 in line with the longitudinal axis of the guide assembly 700.

Figure 9B:
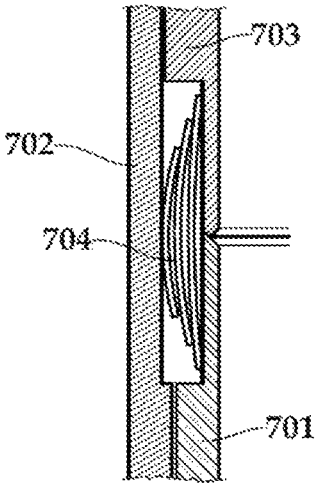

FIG. 9B depicts the structure of the leaf spring when a force is applied by a packer bore to the tilt guide assembly 700 of FIG. 9A. The packer bore applies a force to the lower muleshoe guide 701. This force straightens the arc structure of the leaf spring 704, temporarily flattening the curvature of the sheets, allowing the lower muleshoe guide 701 to align with the upper mandrel 702 and inner mandrel 703. The leaf spring 704 remains in a flattened state until the force applied by the packer bore is removed.

While the aspects of the disclosure are described with reference to various implementations and exploitations, it will be understood that these aspects are illustrative and that the scope of the claims is not limited to them. Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

Example Embodiments

Example embodiments include the following:

A muleshoe guide assembly comprises an upper mandrel having an upper end adapted to couple to well equipment and a lower end. The lower end has a tab extending longitudinally downward. An inner mandrel is inside at least a lower portion of the upper mandrel. A spring is wrapped around the inner mandrel. A muleshoe is concentric to a lower portion of the inner mandrel and coupled to a lower end of the inner mandrel. The muleshoe comprises a milled slot aligned to accept the tab when the spring compresses, allowing the muleshoe to move upwards, and the milled slot slopes downward and outward to tilt the muleshoe as the muleshoe travels upwards, and the spring compresses.

The inner mandrel comprises an inner spring mandrel surrounding the inner diameter of the spring and a lower inner mandrel.

The lower end of the upper mandrel and an upper end of the muleshoe create a gap when the spring is not compressed.

The gap is sufficient to allow the muleshoe to tilt.

The spring comprises a short coil spring.

A muleshoe guide assembly comprises an upper mandrel having an upper end adapted to couple to well equipment and a lower end with a slot along an arc of the lower end. The slot allows a muleshoe to tilt into the slot. The muleshoe guide assembly further comprises an inner mandrel concentrically positioned at least partially within the upper mandrel. A muleshoe is concentric to at least a lower portion of the inner mandrel. A spring is positioned between an inner diameter of the upper mandrel and an outer diameter of the inner mandrel and approximately opposite the slot. The spring tilts the muleshoe towards the slot.

The spring comprises a leaf spring.

The spring is arced to tilt the muleshoe out of longitudinal alignment with the upper mandrel towards the slot.

The spring straightens when compressed and allows the muleshoe to longitudinally align with the upper mandrel.

A muleshoe guide assembly comprises an upper mandrel having an upper end adapted to couple to well equipment and a lower end adapted to allow a muleshoe to tilt out of longitudinal alignment with the upper mandrel. An inner mandrel is concentrically positioned at least partially within the upper mandrel and coupled with the muleshoe. The muleshoe guide assembly further comprises the muleshoe.

A spring is coiled around the inner mandrel. The spring compresses to allow the muleshoe to move upwards. The lower end of the upper mandrel comprises a downward extending tab to tilt the muleshoe out of longitudinal alignment with the upper mandrel as the muleshoe moves upwards.

The muleshoe comprises an external ramp at an upper end of the muleshoe that aligns with the tab of the upper mandrel for the tab to ride as the muleshoe moves upwards.

The spring pushes the muleshoe downward to create a gap between the muleshoe and the upper mandrel.

The lower end is adapted to allow the muleshoe to tilt out of longitudinal alignment with the upper mandrel. The lower end of the upper mandrel has a slot along an arc of the lower end that accepts a portion of an upper end of the muleshoe to allow the muleshoe to tilt into the slot.

A spring is positioned between an inner diameter of the upper mandrel and an outer diameter of the inner mandrel and approximately opposite the slot. The spring tilts the muleshoe towards the slot.

The spring is a leaf spring.

The spring is arced to tilt the muleshoe out of longitudinal alignment with the upper mandrel towards the slot.

The spring straightens when compressed and allows the muleshoe to longitudinally align with the upper mandrel.

What is claimed is:

1. A muleshoe guide assembly comprising:

an upper mandrel having an upper end adapted to couple to well equipment and a lower end, the lower end having a tab extending longitudinally downward;

an inner mandrel inside at least a lower portion of the upper mandrel;

a spring wrapped around the inner mandrel; and a muleshoe concentric to a lower portion of the inner mandrel and coupled to a lower end of the inner mandrel, wherein the muleshoe comprises a milled slot aligned to accept the tab when the spring compresses allowing the muleshoe to move upwards and the milled slot sloping downward and outward to tilt the muleshoe as the muleshoe travels upwards and the spring compresses.

2. The muleshoe guide assembly of claim 1, wherein the inner mandrel comprises an inner spring mandrel surrounding an inner diameter of the spring and a lower inner mandrel.

3. The muleshoe guide assembly of claim 1, wherein the lower end of the upper mandrel and an upper end of the muleshoe create a gap when the spring is not compressed.

4. The muleshoe guide assembly of claim 3, wherein the gap is sufficient to allow the muleshoe to tilt.

5. The muleshoe guide assembly of claim 1, wherein the spring comprises a short coil spring.

6. A muleshoe guide assembly comprising:

an upper mandrel having an upper end adapted to couple to well equipment and a lower end with a slot along an arc of the lower end, wherein the slot allows a muleshoe to tilt into the slot;

an inner mandrel concentrically positioned at least partially within the upper mandrel;

a muleshoe concentric to at least a lower portion of the inner mandrel; and a spring positioned between an inner diameter of the upper mandrel and an outer diameter of the inner mandrel and approximately opposite the slot, wherein the spring tilts the muleshoe towards the slot.

7. The muleshoe guide assembly of claim 6, wherein the spring comprises a leaf spring.

8. The muleshoe guide assembly of claim 6, wherein the spring is arced to tilt the muleshoe out of longitudinal alignment with the upper mandrel towards the slot.

9. The muleshoe guide assembly of claim 6, wherein the spring straightens when compressed and allows the muleshoe to longitudinally align with the upper mandrel.

10. A muleshoe guide assembly comprising:

a muleshoe;

an upper mandrel having an upper end adapted to couple to well equipment and a lower end of the upper mandrel adapted to allow the muleshoe to tilt out of longitudinal alignment with the upper mandrel; and an inner mandrel concentrically positioned relative to the upper mandrel and positioned at least partially within the upper mandrel, a lower end of the inner mandrel coupled with the muleshoe.

11. The muleshoe guide assembly of claim 10 further comprising a spring coiled around the inner mandrel that compresses to allow the muleshoe to move upwards, wherein the lower end of the upper mandrel comprises a downward extending tab to tilt the muleshoe out of longitudinal alignment with the upper mandrel as the muleshoe moves upwards.

12. The muleshoe guide assembly of claim 11, wherein the muleshoe comprises an external ramp at an upper end of the muleshoe that aligns with the tab of the upper mandrel for the tab to ride as the muleshoe moves upwards.

13. The muleshoe guide assembly of claim 11, wherein the spring pushes the muleshoe downward to create a gap between the muleshoe and the upper mandrel.

14. The muleshoe guide assembly of claim 10, wherein the lower end of the upper mandrel being adapted to allow the muleshoe to tilt out of longitudinal alignment with the upper mandrel comprises the lower end of the upper mandrel having a slot along an arc of the lower end of the upper mandrel that accepts a portion of an upper end of the muleshoe to allow the muleshoe to tilt into the slot.

15. The muleshoe guide assembly of claim 14 further comprising a spring positioned between an inner diameter of the upper mandrel and an outer diameter of the inner mandrel and approximately opposite the slot, wherein the spring tilts the muleshoe towards the slot.

16. The muleshoe guide assembly of claim 15, wherein the spring is a leaf spring.

17. The muleshoe guide assembly of claim 15, wherein the spring is arced to tilt the muleshoe out of longitudinal alignment with the upper mandrel towards the slot.

18. The muleshoe guide assembly of claim 15, wherein the spring straightens when compressed and allows the muleshoe to longitudinally align with the upper mandrel.

19. The muleshoe guide assembly of claim 2, wherein a slot between the inner spring mandrel and the lower inner mandrel allows the lower inner mandrel to move unrestricted.

20. The muleshoe guide assembly of claim 19, wherein the slot allows the lower inner mandrel to tilt with the muleshoe as the muleshoe travels upwards and the spring compresses.

* * * * *